United States Patent [19]

Ashworth

[11] 4,151,379

[45] Apr. 24, 1979

[54] ELECTROMAGNETIC SPEAKER WITH BUCKING PARALLEL HIGH AND LOW FREQUENCY COILS DRIVES SOUNDING BOARD AND SECOND DIAPHRAGM OR EXTERNAL APPARATUS VIA MAGNETIC COUPLING AND HAVING ADJUSTABLE AIR GAP AND SLOT POLE PIECE

[76] Inventor: William J. Ashworth, Rte. 2, 1012 W. Lake Brantley, Maitland, Fla. 32751

[21] Appl. No.: 882,376

[22] Filed: Mar. 1, 1978

Related U.S. Application Data

[63] Continuation-in-part of Ser. No. 816,933, Jul., 1977, abandoned.

[51] Int. Cl.[2] ..... H04R 1/02; H04R 3/08; H04R 3/12; H04R 11/02

[52] U.S. Cl. ..... 179/114 R; 179/115 R; 179/116; 179/119 R; 179/178; 179/1 C

[58] Field of Search ..... 178/114 R, 114 A, 115 R, 178/115 A, 116, 119 R, 181 W, 1 C, 2 C, 178, 179

[56] References Cited

U.S. PATENT DOCUMENTS

| | | | |
|---|---|---|---|
| 316,206 | 4/1885 | Waite | 179/119 R |
| 794,137 | 7/1905 | Brecht | 179/115 R |
| 1,048,394 | 12/1912 | Dickinson | 179/185 |
| 1,283,304 | 10/1918 | Rhodus | 179/119 R |
| 1,548,698 | 8/1925 | Young et al. | 179/114 R |
| 1,644,992 | 10/1927 | Davis | 179/116 |
| 2,121,781 | 6/1938 | Ballantine | 179/114 R |
| 2,204,529 | 6/1940 | Cooley | 179/2 C |
| 3,180,937 | 4/1965 | Moser | 179/1 C |
| 3,449,531 | 6/1969 | Ashworth | 179/115 R |

FOREIGN PATENT DOCUMENTS

| | | | |
|---|---|---|---|
| 245727 | 4/1926 | United Kingdom | 179/115 R |

*Primary Examiner*—George G. Stellar

[57] ABSTRACT

An electro-acoustic transducer having a bass and treble coil wound on a single magnetizable core positioned to activate a magnetizable armature at one end of the core and to supply magnetic energy at the other end of the core for the operation of other energy requiring apparatus.

31 Claims, 9 Drawing Figures

ELECTROMAGNETIC SPEAKER WITH BUCKING PARALLEL HIGH AND LOW FREQUENCY COILS DRIVES SOUNDING BOARD AND SECOND DIAPHRAGM OR EXTERNAL APPARATUS VIA MAGNETIC COUPLING AND HAVING ADJUSTABLE AIR GAP AND SLOT POLE PIECE

This application is a continuation in part of my copending application Ser. No. 816,933, filed July 19, 1977, entitled Electro-Acoustic Transducer, now abandoned.

BACKGROUND OF THE INVENTION

The present invention relates to electro-acoustic transducers and more particularly to a simple and efficient method of obtaining better fidelity and efficiency from an electro-acoustic transducer than has been possible in the past, by using dual voice coils wound on a single core. It also provides a novel method of using a pickup coil to utilize unused magnetic energy by the transducer to operate other electrical or magnetic devices with this unused magnetic energy. Heretofore, other electro-acoustic transducers have been proposed, for example, my prior U.S. Pat. Nos. 3,178,512, 3,334,195 and 3,449,531. The present invention provides a method of obtaining better fidelity and greater efficiency. It also provides a method for using a pickup coil to utilize magnetic energy developed by, but unused by the present transducer. Such a use would be to operate a dynamic loudspeaker from the electrical potential developed across the pickup coil of the present invention. The transducer core is also easily adjustable with the operator's fingers to provide the correct air gap between the transducer's core and the vibratory armature plate.

SUMMARY OF THE INVENTION

Electro-acoustic transducers are well known to the art and their operation will not be explained in this application. The present invention provides a method of using two coils wound on a single core, connected in parallel with each coil being responsive to a different but overlapping audio range. Both coils are wound on a single magnetizable core and the core generates magnetic energy at both of its ends, usable without additional amplification. The core is supported in place near its end by a magnetically saturable mounting plate which is in turn supported at one end of a permanent magnet. A vibratory magnetizable armature plate is resiliently supported at the other end of the magnet and this plate is acted on magnetically by the magnetic energy generated at the end of the core away from the core mounting end. For the greatest operating efficiency, the end of the core should be positioned as closely as possible to the armature plate without physical contact with each other while in operation. Contact against one another causes a damping or chatter in the sound. Because sound equipment is manufactured in a great variety of wattage outputs, the present invention has been provided with a simple and effective core adjusting means so the core can be adjusted to and away from the armature plate to accommodate the signal from low power sound equipment as well as high power equipment. The core is frictionally held in place by the mounting plate because the core and mounting plate are snugly fitted together. This core adjustment may be made inward toward the armature plate by pressing with the operator's fingers on the end of the core that extends thru the mounting plate with no more than twenty pounds of pressure. The core may be moved away from the armature plate by the operator holding the body of the transducer firmly and pressing inward toward the armature plate. This will cause the core to press against the armature plate, forcing the core to move rearward. This will move the core outward away from the armature plate when the body of the transducer is released, increasing the distance between the core and the armature plate. The core can be adjusted without disassembling the principle body of the transducer and the adjustment, when made, will hold in place unless a readjustment is made. If desirable, the core may be fixed in position with a suitable cement or by any other suitable method. Another novel feature of the present invention is that a conventional loudspeaker or other electrical or magnetically activated equipment can be operated together with the transducer. This can be done electrically by placing a pickup coil in proximity to the rearward end of the core opposite the armature plate and at the end supported by and protruding thru the mounting plate. The mounting plate provides the biasing magnetic path from the permanent magnet to the core. The mounting plate is constructed of a thin magnetizable material so that there is sufficient material in the mounting plate to magnetically bias the core but an insufficient amount of material to prevent the mounting plate from becoming magnetically pregnant, with magnetically pregnant being defined as a magnetizable substance that is at least ninety percent magnetically saturated, when the transducer is operating. The thinness of the mounting plate also impedes the flow of eddy currents in the mounting plate. To further impede the flow of eddy currents, the mounting plate may have a gap cut in it extending from the core hole to its outer edge. Because of the thinness of the mounting plate, magnetic energy is present at the mounting plate end or rearward end of the core in at least one tenth and not more than three fourths the amount of magnetic energy available at the armature plate end of the core when measured at 400 cycles per second. The mounting plate operational theory set forth is the applicant's opinion and may or may not be correct. This ratio can be changed by varying the thickness of the mounting plate. The thicker the mounting plate, the less magnetic energy will be available at the mounting plate end of the core. The mounting plate may be electrically insulated from the core but better sound performance is accomplished when electrical contact is made between the two. Enough magnetic energy can be made available to magnetically activate a speaker cone directly from the mounting plate end of the core. The ratio of magnetic energy available at each end of the core was measured by the applicant by feeding a 400 cycles per second tone signal to the coils of the transducer and placing a pickup coil with an 8 ohm resistive load across the pickup coil, wound on an iron core against each end of the transducer core. The voltage developed across the pickup coil was measured at each end of the core. The magnetic energy ratio varied at different frequency inputs so the claims of the application are based on a frequency input to the transducer coils of 400 cycles per second and the claims are also based on the measurement procedure just outlined. This ratio will vary and is dependent on the thickness of the core mounting plate and the operating signal frequency. Each end of the core of the transducer generates usable magnetic energy. One end of the transducer core energizes the transducer's armature plate, causing vibratory action. A pickup coil is wound on a core separate from the transducer core. The pickup coil and core is movable toward and away from the mounting end of the transducer core. The closer the pickup coil is to the transducer core, the greater will be the energy available from the pickup coil to operate a loudspeaker or other electrical device. The pickup coil is mounted on the closed end of a ribbed sleeve that fits over the principle body of the transducer. The sleeve is constructed of a flexible material having ribs on its inner periphery that causes the sleeve to slightly distort when pushed over the principle body of the transducer, causing a mild clamping action of the sleeve on the transducer body. The sleeve can be easily moved in and out, longitudinally or even rotated over the transducer but will stay in place unless moved. By moving the closed end of the sleeve to and away from the transducer, the pickup coil is moved closer to, or away from the transducer core. This causes the magnetic coupling between the transducer core and the pickup coil to vary and this provides an energy intensity control for the electrical apparatus being operated with the electrical potential developed at the pickup coil output terminals. The pickup coil sleeve also provides two other advantages. When the transducer is operating at high power levels, the transducer body becomes hot to the touch. Because of the longitudinal ribs inside the sleeve over the transducer, an air space is provided between the transducer and the sleeve. This air space acts as an insulator and the sleeve remains relatively cool to the touch. The air space between the transducer and sleeve also provides an entry space for the wire from the sound equipment to the transducer. The more iron the pickup coil's core consists of, the more efficient will be the coupling between the transducer's core and the pickup coil. Because of the unavailability of sufficient space to use a large pickup coil core, a novel configuration is used to obtain better coupling between the transducer core and pickup coil than with the use of a long and heavier core. A flat magnetizable plate may be mounted in the rear and center of and adjacent to the pickup coil. The pickup plate intensifies the coupling between the transducer core and the pickup coil approximately five times when the transducer is operating at 50 cycles per second and the enhanced coupling tapers downward as the operating frequency is increased where at approximately 1500 cycles per second, the pickup plate no longer has much effect on the pickup coil and core. This bass boosting effect, caused by the pickup coil plate, is particularly effective when using the pickup coil to operate a dynamic or other type loudspeaker together with the present invention. Even an inexpensive speaker will sound remarkably good and will give the impression of being a second channel when operated together with the present invention. The preferred embodiment of the present invention uses a solid cold or hot rolled soft iron pickup coil core. The reason for this is that the eddy currents in the solid core attenuate the treble notes and with the bass boosting effect of the pickup coil plate, when a dynamic speaker is operated together with the transducer of the present invention, the sound from the speaker sounds like a totally separate sound channel tracking the sound caused by the transducer. The present invention can be built with a laminated or other high efficiency pickup coil core and without the pickup coil plate. The transducer of the present invention uses two coils wound on the same core. The preferred embodiment of the present invention uses a laminated core but it would be possible to use any other suitable core material such as solid bar stock. A treble coil is wound on the core and a second bass coil is wound on the same core. The treble coil is wound toward the armature plate end of the core and the bass coil may be wound over or adjacent to the treble coil. The two coils are connected in parallel with a capacitor, in series with the treble coil and in parallel with the bass coil. When operating, the low frequency electrical signals pass thru the bass coil but are blocked by the capacitor from passing thru the treble coil. The treble signals are blocked by the inductance present in the bass coil but are able to pass thru the capacitor and the treble coil. A resistor may be used in place of the capacitor but this will result in loss of fidelity and reduced operating efficiency of the transducer. At the frequency range where both coils will pass the same signal, transformer action takes place between the two coils, causing an electrical current bucking action between the two coils. The closer the coupling, the greater this bucking action will be. This bucking action is very useful because it increases the impedance of the treble coil at the crossover range of the treble and bass coil. If it were not for this artificial increase in the treble coil impedance, more turns of wire wound be necessary on the treble coil or the use of a smaller wire would be required to introduce resistance in the circuit. This would be required to keep the impedance of the treble coil from becoming too low for 8 ohm sound equipment at the crossover range. More turns of wire on the treble coil would impede the high end performance of the treble coil or the use of smaller wire to obtain more resistance would lower the coil efficiency. A secondary coil may be wound on the transducer's core to electrically drive an external electrical energy requiring apparatus. Other devices may be directly magnetically activated at the mounting plate rearward end of the transducer's core. An example of such a magnetic device is a paper speaker cone with a magnetizable piece attached to the apex end of the cone and mounted in proximity to the rearward end of the transducer's core.

DESCRIPTION OF THE PREFERRED EMBODIMENTS

Figure 1:
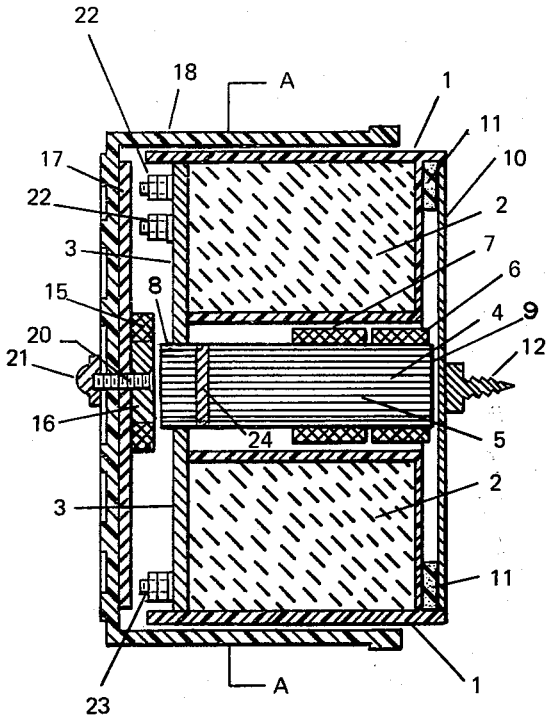
FIG. 1 is a sectional view of the present invention.
Figure 2:
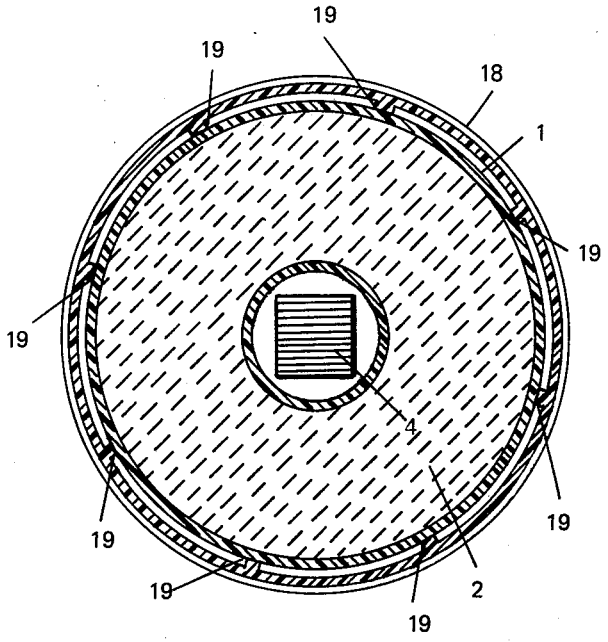
FIG. 2 is a sectional view of the present invention taken along A—A of FIG. 1.
Figure 3:
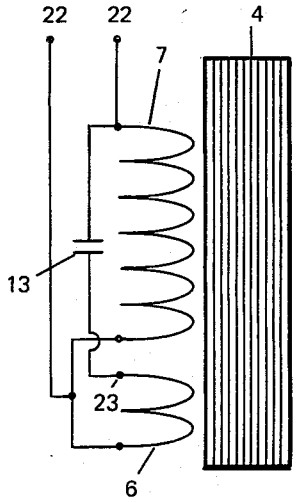
FIG. 3 is a schematic drawing showing a magnetic core and a bass and treble coil with a capacitor in series with the treble coil.
Figure 4:
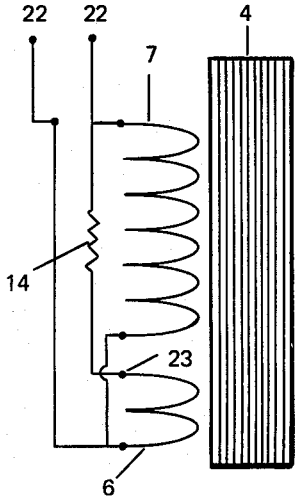
FIG. 4 is a schematic drawing showing a magnetic core and a bass and treble coil with a resistor in series with the treble coil.
Figure 5:
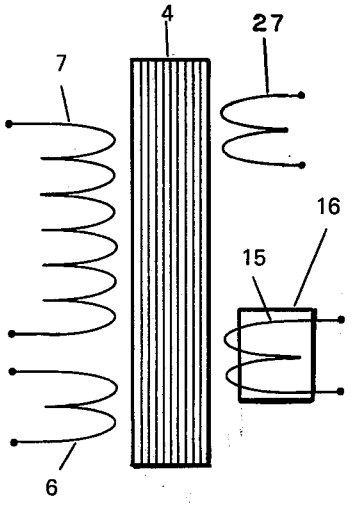
FIG. 5 is a schematic drawing showing a magnetizable core, a bass and treble coil, a pickup coil and core, and a secondary winding.
Figure 6:
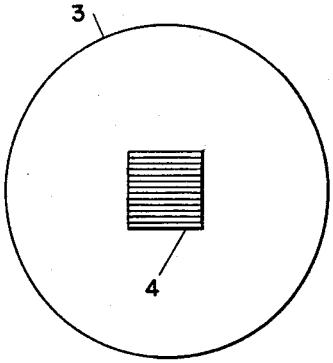
FIG. 6 is a view of the central magnetizable core and magnetizable mounting plate of the present invention.
Figure 7:
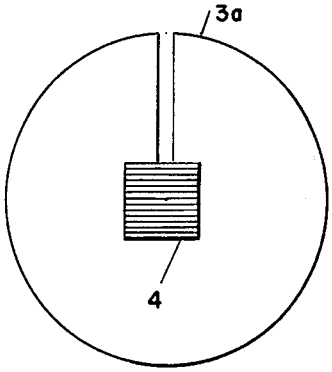
FIG. 7 is a view of the central magnetizable core and magnetizable plate with a gap cut in the magnetizable plate.
Figure 8:
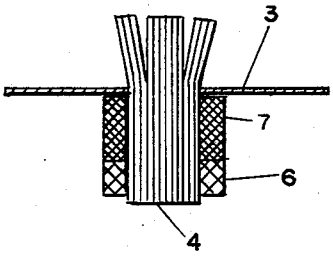
FIG. 8 is a sectional view of the central magnetizable core, the magnetizable mounting plate and the bass and treble coil of the present invention showing how the central core's laminations are bent outward to cause a spring action to hold the central core in position when the core is pressed into position.
Figure 9:
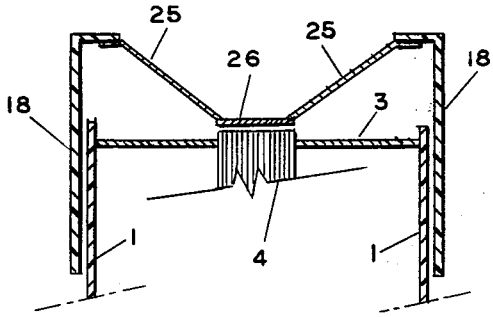
FIG. 9 is a diagrammatic view of the central core, the permanent magnet housing and a sleeve over the housing of the present invention showing a loudspeaker cone positioned in proximity to the central core.

The permanent magnet cup 1 is formed of plastic or any other suitable material and holds the permanent magnet 2 in place. Core 4 is preferable constructed from laminated silicon steel. Other materials may be used such as unlaminated iron or steel or high efficiency solid core material with the core material being magnetically responsive to varying electrical stimulus such as in soft iron magnetic core material or silicon steel. This is the type of material being referred to in the claims of this application when magnetizable core or magnetizable material is referred to. Magnetizable core or magnetizable material does not refer to permanent magnet material unless permanent magnet is specified. Core 4 may be rigidly attached to plate 3 with a cement or other suitable fastening means if desired, but in the preferred embodiment, core 4 is movable and may be moved in or out to adjust for different air gap requirements between the forward end of 9 of core 4 and armature 10 with no more than twenty pounds of pressure applied to appropriate end of core 4. Laminations 5 are stuffed into voice coils 6 and 7 and plate 3 so they are very snug. The outer laminations are bent outward as shown in FIG. 8 so as to cause spring tension when core 4 is properly positioned near its rearward end on mounting plate 3 as shown in FIG. 1 and FIG. 9. Under finger pressure core 4 can be repositioned either in or out and when it is repositioned it will stay in place until repositioned. Pin 24, although not necessary, may be inserted thru laminations 5 for lamination alignment. Vibrating armature plate 10 is attached to rubber gasket 11 with a suitable cement and gasket 11 is secured to magnet cup 1 with a suitable cement. An air gap exists between vibrating plate 10 and the forward end 9 of core 4. This gap is adjustable in the preferred embodiment of this invention. Attaching screw 12 is for attaching the transducer to a mounting surface. Screw 12 may be eliminated and vibrating plate 10 may be attached directly to a mounting surface that is to be vibrated with cement or other suitable means. One voice coil may be used on core 4 but good fidelity cannot be obtained with only one voice coil. If the transducer is to be used with 8 ohm sound equipment, then sufficient turns will be necessary to obtain this average impedance. A sufficient number of turns to accomplish this results in a very bassy sound with the treble tones blocked. If enough turns are eliminated from the voice coil to produce the treble sound, the bass notes are shorted out and the effective impedance of the coil drops sufficiently to overload 8 ohm sound equipment. To overcome this problem, two voice coils are used in the preferred embodiment of the present invention. The bass voice coil 7 has approximately 200 turns of No. 27 copper magnet wire and the treble voice coil 6 has approximately 80 turns of No. 25 copper magnet wire. Number 27 wire is used so approximately 2½ ohms of resistance is present in the bass coil 7. This resistance, together with the inductive impedance of coil 7, will afford an acceptable load for 8 ohm sound equipment without adding additional turns to the bass coil 7 so as to create an overly bass response. The treble coil 6 may be wound from a larger size wire because the capacitor 13 or resistor 14 will limit the current flow of the bass tones thru the treble coil without the need of additional resistance present in coil 6. In the preferred connection, coils 6 and 7 are connected in parallel with capacitor 13 in series with treble coil 6 but with capacitor 13 in parallel with bass coil 7. When a bass signal is delivered to the coils, capacitor 13 blocks this signal from passing thru treble voice coil 6 and allows the signal to pass thru bass voice coil 7. When a treble signal is delivered to the voice coils, capacitor 13 acts as a shunt around bass voice coil 7 and allows the signal to pass thru treble voice coil 6. The circuit arrangement shown in FIG. 4 may be a 3 ohm resistor 14 instead of a capacitor. In the preferred embodiment, coils 6 and 7 are positioned on core 4 as closely together as possible because of the transformer action that takes place between coils 6 and 7 when the two coils are operating in their crossover overlapping range. The closer together coils 6 and 7 are positioned, the greater will be the transformer action. This transformer action causes a current bucking effect to take place between the coils and increases the impedance of coil 6, so fewer turns than would normally be required can be used on coil 6. FIG. 5 shows the two voice coils 6 and 7 as well as the magnetic pickup coil 15. Pickup coil 15 is mounted on a magnetic core 16. The pickup coil 15 and pickup core 16 are mounted against a magnetic plate 17, constructed from 18 gauge cold rolled steel 2⅛" in diameter. Plate 17 causes the signal picked up by coil 15 to be greatly increased in the bass range on the order of approximately five to one. Coil 15, core 16 and plate 17 are all fastened to sleeve 18 with screw 20 and cap nut 21. Sleeve 18 may be moved in or out to adjust sound level of the loudspeaker or other equipment connected to the pickup coil terminals. The sleeve 18 has ribs 19 moulded inside the inner periphery of the sleeve. These ribs 19 serve several purposes. One purpose is to provide a bearing surface for the sleeve 18 to ride in and out on cup 1. Another purpose is to provide a spring clamping effect. When the sleeve 18 is pressed on cup 1, the ribs 19 are forced slightly outward, causing sleeve 18 to be slightly distorted. Preferably, the sleeve should be moulded from a pliable plastic. As the plastic sleeve attempts to return to its original undistorted position, ribs 19 are pushed against cup 1, causing sleeve 18 to grip cup 1, holding sleeve 18 in place unless purposely moved. Another purpose for the ribs is to provide an opening for lead wires to pass thru from terminal connections 22 to the outside of the transducer. A terminal 23 is a connection to connect capacitor 13 or resistor 14 between bass coil 7 and treble coil 6. A further reason for ribs 19 is to have an air insulated jacket around the transducer. When the transducer is operated at high power inputs, the entire unit becomes hot to the touch. The air pockets between sleeve 18 and cup 1 greatly reduced this heating problem. The capacitor 13 or resistor 14 is connected between terminals 22 and 23 and may be concealed in the opening between cup 1 and sleeve 18 or it may be placed outside the transducer. A loudspeaker cone 25 with a magnetic plate 26 attached to the apex of cone 25 may be mounted near the rearward end 8 of core 4 as shown in FIG. 9 with the cone 25 supported by a movable sleeve similar to sleeve 18. The magnetic energy available at end 8 of core 4 will act on cone plate 26, causing cone 25 to vibrate and produce sound. Core 4 may also have a secondary winding 27 wound on it to operate electrical apparatus such as a tweeter loudspeaker.

Although one form of the present invention has been shown, it will be understood that details of the construction shown may be altered or omitted without departing from the spirit of this disclosure as defined by the following claims.

I claim:

1. An electro-acoustic transducer, principally enclosed in a housing, comprising a driving element including a single magnetizable core having one north pole and one south pole that generates usable power producing magnetic energy at both of its poles, where the said core's rearward end produces at least one tenth and not more than seven tenths of the usable magnetic energy as produced by the forward end of said core when said transducer is operating at 400 cycles per second, two electrically parallel coils wound toward the forward end of said core for magnetically actuating said driving element, whereby said coils are supported by said core, wherein said coils are in circuit with and energized by the same electrical power source with one said coil consisting of more turns than the other said coil, wherein the said coil consisting of the least number of turns has electrical current regulating means in series with it, said core being solidly attached toward its rearward end to mounting means providing a magnetic path to said core from magnetic biasing means that will become magnetically pregnant before said core, an armature of magnetizable material for transmitting vibratory motion to a sounding board mounted in axially spaced relation at the forward end of said core, resilient coupling means connecting said armature with said mounting means for permitting relative motion and power transfer between said driving element and said armature element, magnetic biasing means disposed between said mounting means and said armature, wherein separate magnetic pickup means is positioned in proximity to the rearward end of said core for transferring power to energize other apparatus without the use of additional amplifying equipment.

2. An electro-acoustic transducer according to claim 1 where said electrical current regulating means is a capacitor.

3. An electro-acoustic transducer, according to claim 1 where said electrical current regulating means is a resistor.

4. An electro-acoustic transducer according to claim 1 wherein said core and said mounting means are in electrical metal to metal contact with each other.

5. An electro-acoustic transducer according to claim 1 wherein said pickup means is a magnetically activated device positionable in proximity to the rearward end of said core as to cause said device to operate.

6. An electro-acoustic transducer according to claim 1 with said coils being electrically coupled together on a single said core, operating together in the same electrical circuit from the same electrical signal source of approximately 400 thru approximately 800 cycles per second, thereby causing transformer action between the two said coils, wherein because of said transformer action, the impedance of said coil with the least number of turns is increased by at least ten percent.

7. An electro-acoustic transducer according to claim 1 where said magnetic pickup means is an electro-magnetically activated loudspeaker cone.

8. An electro-acoustic transducer according to claim 1 wherein said core is mounted to a magnetic plate where it is fixidly mounted to said magnetic biasing means with said plate having a hole therein, permitting the passage of one end of said core thru said plate where said core is fastened in position near its rearward end to said plate.

9. An electro-acoustic transducer according to claim 1 where a secondary coil of wire is wound on said transducer's core for operating external electrical consuming apparatus.

10. An electro-acoustic transducer according to claim 1 where said core is held in position near its said rearward end relative to said mounting means by frictional contact only with said mounting means and said core is movable in or out longitudinally with relation to said plate with no more than twenty pounds of pressure applied to said core with the direction of movement of said core being dependent on the end of said core said pressure is applied.

11. An electro-acoustic transducer according to claim 1 where said core is constructed from a laminated magnetizable material.

12. An electro-acoustic transducer according to claim 1 wherein said coil with the greatest number of turns uses a smaller gauge wire than the said coil with the least number of turns.

13. An electro-acoustic transducer according to claim 1 wherein said transducer's core is contained in said housing, said transducer having an outer sleeve positioned over said housing with one end closed where said sleeve is constructed of a flexible material having longitudinal ribs on its inner periphery wherein said ribs cause said sleeve to slightly distort when pushed over said housing, causing a clamping action of said sleeve to said housing, where said sleeve is movable in and out and rotatable on said transducer's housing, with said separate magnetic pickup means being mounted on said closed end of said sleeve.

14. An electro-acoustic transducer according to claim 1 where said mounting means is slotted from its outer edge to a hole therein.

15. An electro-acoustic transducer according to claim 1 wherein a flexible sleeve having longitudinal ribs on its inner peripheral surface with said ribs extending inward toward the peripheral center of said sleeve, where the inner diameter of said ribs is smaller than the outer diameter of said housing where said sleeve is pushed over said housing, said ribs ride on the outer peripheral surface of said housing causing said sleeve to distort, causing said sleeve to clamp against said housing with said sleeve being movable in and out over said housing and rotatable on said housing.

16. An electro-acoustic transducer according to claim 15 where said sleeve is closed at one end and said separate magnetic pickup means is mounted to said closed end.

17. An electro-acoustic transducer according to claim 1 where said pickup means is a pickup coil wound on a core separate from said transducer's core and is positioned in proximity to said rearward end of said transducer's core.

18. An electro-acoustic transducer according to claim 17 wherein said pickup coil is adjustable to and away from said transducer's core.

19. An electro-acoustic transducer according to claim 17 wherein said pickup coil and said pickup coil's core has a magnetizable plate, having at least three times the distance across it horizontally as the horizontal distance across the said pickup coil's core, mounted against their rearward faces opposite from the rearward end of said transducer's core.

20. An electro-acoustic transducer principally enclosed in a housing comprising a driving element including a single magnetizable core wherein said core is mounted near its rearward end to a magnetic plate with said plate attached to magnetic biasing means, two current carrying coils of wire wound on and mounted toward the forward end of said core with one said coil having no more than one half the turns of wire than the other said coil, wherein said coil with the least number of turns has a capacitor connected in series with it, with said coil having the least number of turns and said capacitor being connected in parallel with said coil having the greater number of turns, wherein said parallel circuit is connected to a signal supplying source where the currents in said coils operate more than ninety degrees and less than one hundred eighty degrees out of phase with each other when said signal source is operating at a position between three hundred and eight hundred cycles per second.

21. An electro-acoustic transducer according to claim 20 wherein both said coils conduct a range of electrical signals simultaneously and each said coil primarily conducts other ranges of electrical signals individually, wherein said coils operate in electrical opposition to each other when both said coils are conducting the same electrical signals simultaneously.

22. An electro-acoustic transducer according to claim 20 where said core is held in position near its said rearward end relative to said mounting plate by frictional contact only with said mounting plate with said frictional contact being caused by spring tension embodied in said core with said tension urging said core against said mounting plate and said core is movable in or out longitudinally with relation to said plate with no more than twenty pounds of longitudinal pressure applied to said core with the direction of movement of said core being dependent on the end of said core said pressure is applied.

23. An electro-acoustic transducer according to claim 20 where said mounting plate is slotted from its outer edge to a hole therein.

24. An electro-acoustic transducer according to claim 20 wherein said coil with the greatest number of turns uses a smaller gauge wire than the said coil with the least number of turns.

25. An electro-acoustic transducer according to claim 20 wherein said core is mounted to and solely supported by a magnetizable plate where said plate is fixedly mounted to said magnetic biasing means with said plate having a hole therein, permitting the passage of one end of said core thru said plate where said core is fastened in position near its rearward end to said plate wherein said plate becomes magnetically pregnant before said core.

26. An electro-acoustic transducer according to claim 25 where said mounting plate supplies a magnetic path from said magnetic biasing means to said core for magnetically biasing said core wherein said mounting plate becomes magnetically pregnant before said core causing a field of magnetic flux to be generated at the said rearward end of said core being supported by said mounting plate in at least a one to ten ratio of the magnetic flux generated at the said forward end of said core.

27. An electro-acoustic transducer according to claim 25 where said mounting plate is slotted from its outer edge into its said hole therein.

28. An electro-acoustic transducer according to claim 20 where said mounting plate supplies a magnetic path from said magnetic biasing means to said core for magnetically biasing said core wherein said mounting plate becomes magnetically pregnant before said core, causing a field of magnetic flux to be generated at the said rearward end of said core being supported by said mounting plate in at least a one to ten ratio of the magnetic flux generated at the said forward end of said core.

29. An electro-acoustic transducer according to claim 28 where a pickup coil is wound on a core separate from said transducer's core and is positioned in proximity to said rearward end of said transducer's core.

30. An electro-acoustic transducer according to claim 29 wherein said pickup coil and said pickup coil's core has a magnetizable plate, having at least three times the distance across it horizontally as the horizontal distance across the said pickup coil's core, mounted against their rearward faces opposite from the rearward end of said transducer's core.

31. An electro-acoustic transducer according to claim 28 where said magnetic flux generated at said rearward end of said core, actuates an electro-magnetically activated loudspeaker cone.

* * * * *